United States Patent [19]

Kohler et al.

[11] 3,941,959

[45] Mar. 2, 1976

[54] VACUUM SWITCHING APPARATUS WITH A DRIVE UNIT AT GROUND POTENTIAL

[75] Inventors: Werner Kohler, Bentfeld, Holstein; Norbert Steinemer, Berlin, both of Germany

[73] Assignee: Siemens Aktiengesellschaft, Munich, Germany

[22] Filed: Apr. 25, 1974

[21] Appl. No.: 464,242

[52] U.S. Cl. ..... 200/144 B

[51] Int. Cl.[2] ..... H01H 33/66

[58] Field of Search ..... 200/144 B, 148 R, 148 A, 200/144 R

[56] References Cited

UNITED STATES PATENTS

| | | | |
|---|---|---|---|
| 3,471,669 | 10/1969 | Curtis | 200/144 B |
| 3,582,588 | 6/1971 | Cichocki et al. | 200/144 B |
| 3,813,506 | 5/1974 | Mitchell | 200/144 B |

FOREIGN PATENTS OR APPLICATIONS

| | | | |
|---|---|---|---|
| 951,409 | 3/1964 | United Kingdom | 200/148 A |

*Primary Examiner*—Robert S. Macon
*Attorney, Agent, or Firm*—Kenyon & Kenyon Reilly Carr & Chapin

[57] ABSTRACT

A vacuum switching apparatus is equipped with a switching vessel which can be actuated by a drive unit at ground potential by means of a drive assembly transmitting the drive motion. The drive assembly includes a lever made of insulating material which is fulcrumed about an electrically conductive bearing pin. The lever serves as the actuating member of the switching vessel and the bearing pin is at an intermediate potential between the grounded and the high-voltage-carrying parts.

The invention is suited particularly for single-pole or multi-pole vacuum switching apparatus in the medium-voltage range.

3 Claims, 2 Drawing Figures

VACUUM SWITCHING APPARATUS WITH A DRIVE UNIT AT GROUND POTENTIAL

BACKGROUND OF THE INVENTION

The invention relates to a vacuum switching apparatus with switching vessels which can be actuated by a drive unit at ground potential by means of an actuating member. The actuating member has the function of transmitting a mechanical motion from the drive unit to the switching vessel as well as of bridging a potential difference between the drive unit and the switching vessel. In known vacuum switching apparatus this is achieved by utilizing a lever made of conductive material which is coupled with the actuating member of the switching vessel with an interposed insulating member.

SUMMARY OF THE INVENTION

It is an object of the invention to provide an improved drive assembly for a vacuum switching apparatus. Subsidiary to this invention, it is an object of the invention to provide such an assembly which has improved mechanical and electrical characteristics.

The foregoing objects are realized in a vacuum switch apparatus which includes a switching vessel operable at high potential and a drive unit at ground potential. The drive unit is equipped with a drive assembly for actuating the switch of the switching vessel. According to a feature of the invention, the drive assembly is equipped with an actuating lever made of insulating material extending between the drive unit and the switching vessel. The lever consists of insulating material and is fulcrumed about a conductive bearing pin. The lever can be a two-armed lever for example and serves as the actuating member of the switching vessel. The bearing pin is arranged at an intermediate potential. This leads to a relatively favorable dielectric stress of the insulating material and therefore, to small dimensions. It is especially advantageous that a separate insulating member is no longer needed. The intermediate potential can be obtained by arranging the bearing pin for the lever at a definite distance from the voltage-carrying parts and the parts at ground potential.

According to another feature of the invention, the bearing pin supporting the lever, together with the movable actuating plunger of the switching vessel, can be located in a chamber which is associated with the high-voltage potential and is closed off from the ambient atmosphere. An opening in the wall of the housing accommodates the passage therethrough of the lever. At this opening there is provided a diaphragm-like insulating and sealing member consisting of rubber-elastic material.

The lever arm making contact with the switching vessel can be designed in the form of a fork, and the ends of the fork may be provided with slots, with which a pin disposed transversely to the actuating plunger of the switching vessel engages. This arrangement is distinguished by low structural height and a favorable application of the forces.

The lever can be given advantageous dimensions and properties by using oriented glass fibers as filler for the insulating material used in its manufacture.

Although the invention is illustrated and described herein as a vacuum switching apparatus with a drive unit at ground potential, it is nevertheless not intended to be limited to the details shown, since various modifications may be made therein within the scope and the range of the claims. The invention, however, together with additional objects and advantages will be best understood from the following description and in connection with the accompanying drawing.

DESCRIPTION OF THE PREFERRED EMBODIMENTS OF THE INVENTION

Figure 1:
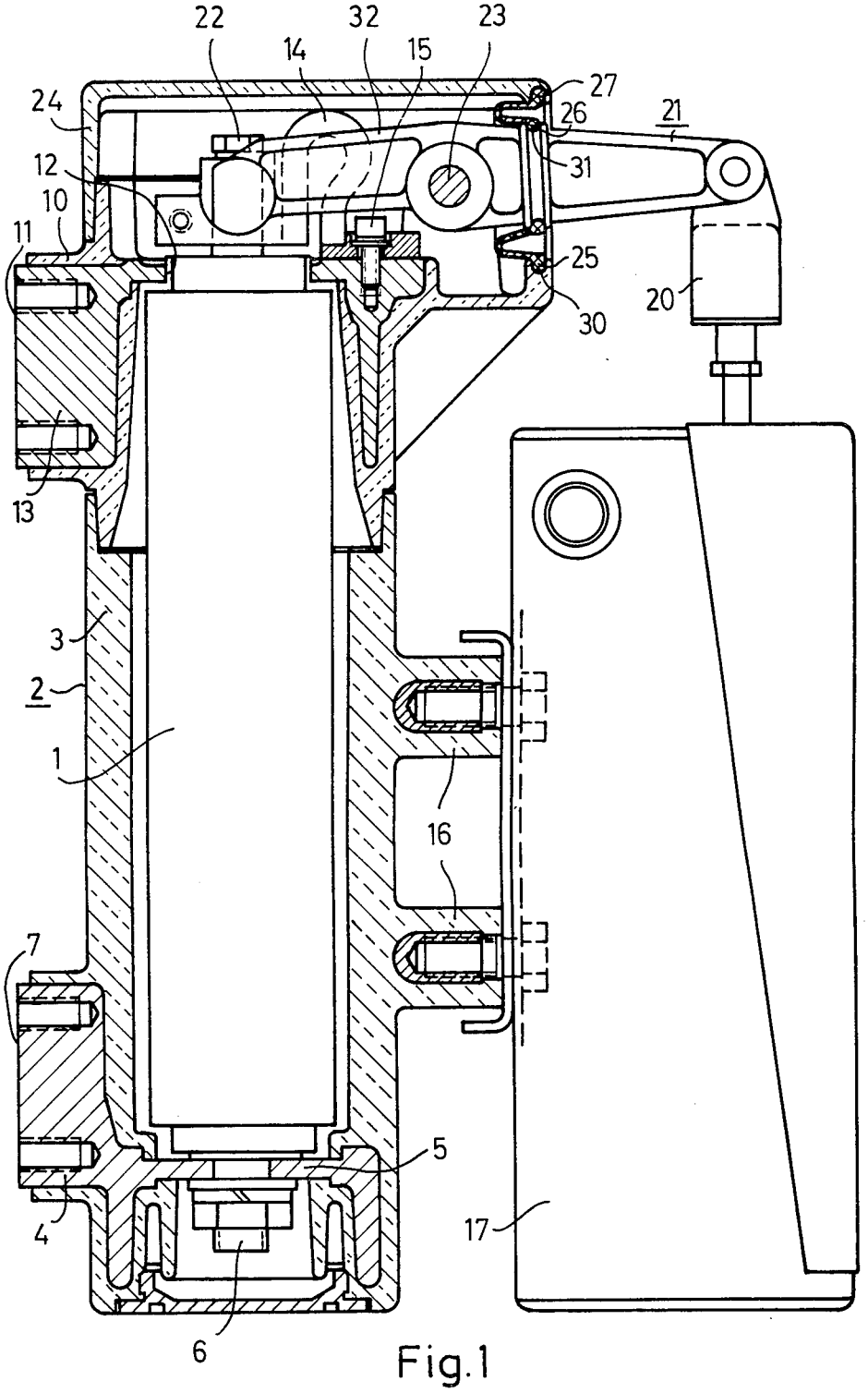
FIG. 1 is a schematic diagram, partially in section, illustrating a vacuum switching apparatus equipped with an improved drive assembly according to the invention.

A switching vessel 1 is disposed in a housing 2 closed on all sides which may consist of a suitable insulating material such as a cast resin for example. The housing 2 consists of a lower part 3, an upper part 10 and a cover 24. The lower part 3 of the housing 2 contains an embedded metal part 4. Metal part 4 has a contact surface 5 for the lower contact post 6 of the switching vessel 1 and an extension 7 for connection to a bus bar. The upper part 10 of the housing 2 contains an additional, similarly shaped metal part 11 which has an opening 12 for the upper end of the switching vessel 1 and also an extension 13 for connecting a bus bar. A flexible conductor band 14 serves to electrically connect the metal part 11 with the upper terminal of the switching vessel 1. The conductor band 14 is fastened to the metal part 11 by means of a clamping screw 15.

On bosses 16 of the lower part 3 of the housing 2, an actuator box 17 is attached which is at ground potential and contains a suitable actuator mechanism. A drive rod 20 extends from the actuator box 17 and is arranged essentially parallel to the switching vessel 1. The drive rod 20 is articulately connected by means of a joint with a lever 21 which consists of insulating material and drives the switching vessel 1. For this purpose, the lever 21 is linked with the actuating plunger 22 of the switching vessel 1 and is pivotally mounted on a bearing pin 23. The bearing pin 23 consists of metal and is at an intermediate potential because of its arrangement between the voltage-carrying actuating plunger 22 and the drive rod 20 at the actuator box 17 at ground potential.

A cover 24 is placed on the upper part 10 of the housing 2. This forms a chamber which contains the voltage-carrying actuating plunger 22 of the switching vessel 1 as well as the flexible conductor 14 connected therewith and the bearing pin 23. This chamber is sealed from the environment at the feedthrough point of the lever 21 by a diaphragm-like sealing member 25 consisting of a rubber-elastic insulating material. The sealing member 25 has inner and outer sealing lips 26 and 27 which engage with a slot 30 provided at the circumference of the feedthrough opening and with a further slot 31 provided at the lever 21. The larger part of the lever 21 is therefore in a dust-free, dry zone.

Figure 2:
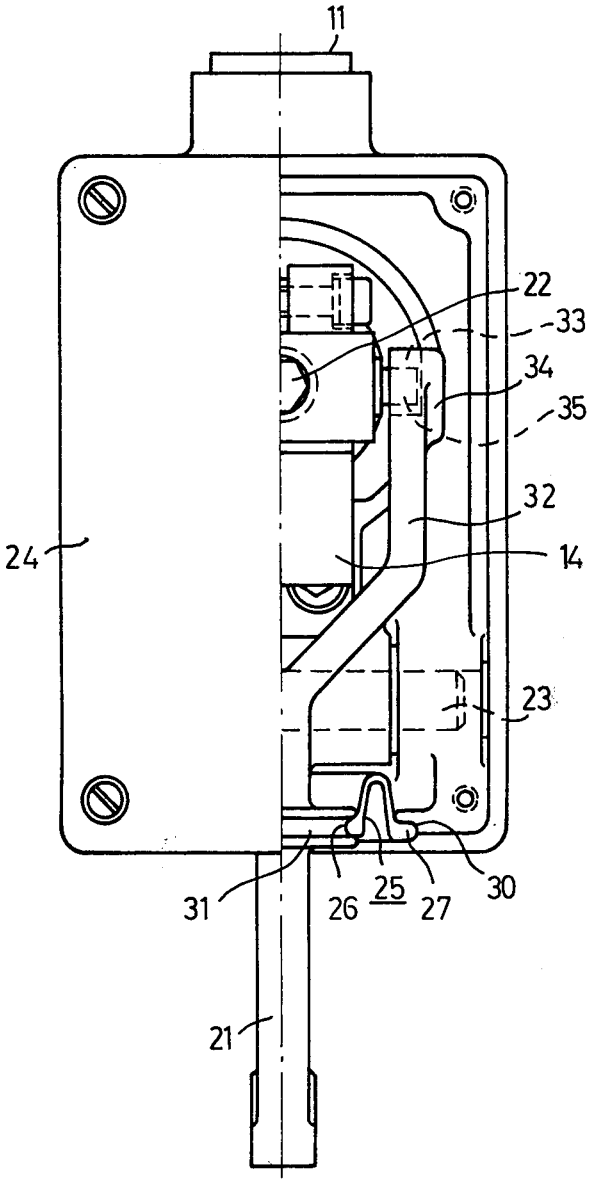
FIG. 2 is a plan view of the upper portion of the vacuum switching apparatus shown in FIG. 1 wherein the right half portion of the FIG. shows details of the drive assembly according to the invention.

As is shown in FIG. 2, the lever arm 32 facing the switching vessel 1 is configured in the form of a fork with the bearing pin 23 approximately extending through the forking point. At the ends of the fork prong portions 34 are provided slots 33 with which a pin 35 engages. The pin 35, in turn, is connected with the actuating plunger 22 of the switching vessel. The lever 21 may be configured with a profiled cross-section and may consist of a plastic which is reinforced with oriented glass fibers.

The invention is equally well suited for single, two or multi-pole vacuum switching apparatus wherein each pole may be of the construction described. For such apparatus, however, a common actuating device can advantageously be provided to act by means of a cross piece on the levers of insulating material corresponding to respective switching vessels.

What is claimed is:

1. In a vacuum switch apparatus including a switching vessel operable at and including parts at high potential, and a drive unit at ground potential equipped with a drive assembly for actuating the switch of the switching vessel, the drive assembly comprising:

an actuating lever made of insulating material extending between the drive unit and the switching vessel;

an electrically conductive bearing pin for pivotally supporting said lever, said electrically conductive bearing pin being mounted in said apparatus between said switching vessel and drive unit and being at a potential intermediate said high potential and said ground potential;

a cover mounted on said switching vessel to define an enclosed space with respect to said parts of the switching vessel, said lever being connected to said switching vessel at one of said parts thereof, said electrically conductive bearing pin and the portion of said lever connected to the switching vessel being contained within said cover;

a housing for accommodating the switching vessel therein, said electrically conductive bearing pin being mounted in said housing, and said cover being a removable part of the housing, said housing having an opening formed therein for accommodating the passage therethrough of the portion of said lever extending to the drive unit; and a membrane-like insulating and sealing member arranged at said opening in surrounding relation to said lever, whereby said space in said cover is maintained as a dust-free, dry zone.

2. The drive assembly of claim 1 wherein said one part of the switching vessel is the actuating plunger thereof, said portion of said lever connected to the switching vessel having a fork-like configuration, the prong-like portions of said lever defining said fork-like configuration having respective slots, and a pin connected to the actuating plunger and extending transverse to the same, said last-mentioned pin engaging said prong-like portions at said slots.

3. The drive assembly of claim 1, said actuating lever being made of synthetic material reinforced by glass fibers having a predetermined orientation.

* * * * *